US009920282B2

(12) United States Patent
Gibis et al.

(10) Patent No.: US 9,920,282 B2
(45) Date of Patent: Mar. 20, 2018

(54) COMPOSITION AND METHOD

(71) Applicant: Reckitt Benckiser N.V., Hoofddorp (NL)

(72) Inventors: Karl Ludwig Gibis, Limburgerhof (DE); Dietmar Van Loyen, Ludwigshafen (DE); Chris Efstathios Housmekerides, Ludwigshafen (DE)

(73) Assignee: RECKITT BENCKISER FINISH B.V., hoofddorp (NL)

( * ) Notice: Subject to any disclaimer, the term of this patent is extended or adjusted under 35 U.S.C. 154(b) by 0 days.

(21) Appl. No.: 14/721,120

(22) Filed: May 26, 2015

(65) Prior Publication Data

US 2015/0252301 A1 Sep. 10, 2015

Related U.S. Application Data

(62) Division of application No. 12/094,300, filed as application No. PCT/GB2006/004389 on Nov. 23, 2006, now abandoned.

(30) Foreign Application Priority Data

Nov. 25, 2005 (GB) ..... 0524009.8

(51) Int. Cl.

| | |
|---|---|
| ***C11D 3/20*** | (2006.01) |
| ***C11D 17/00*** | (2006.01) |
| ***C11D 1/72*** | (2006.01) |
| ***C11D 3/00*** | (2006.01) |
| ***C11D 3/37*** | (2006.01) |
| ***C11D 17/04*** | (2006.01) |
| ***C11D 11/00*** | (2006.01) |

(52) U.S. Cl.

CPC ..... *C11D 3/2086* (2013.01); *C11D 1/72* (2013.01); *C11D 3/0026* (2013.01); *C11D 3/3707* (2013.01); *C11D 11/0041* (2013.01); *C11D 17/0008* (2013.01); *C11D 17/0017* (2013.01); *C11D 17/043* (2013.01)

(58) Field of Classification Search

CPC ..... C11D 7/06; C11D 9/26; C11D 3/0026; C11D 3/3707; C11D 11/0041

See application file for complete search history.

(56) References Cited

U.S. PATENT DOCUMENTS

| | | | | |
|---|---|---|---|---|
| 3,931,033 | A * | 1/1976 | Lohr et al. | 510/422 |
| 3,969,134 | A | 7/1976 | Batka | |
| 4,115,457 | A * | 9/1978 | Wiedemann | 568/625 |
| 4,259,217 | A | 3/1981 | Murphy | |
| 4,276,205 | A * | 6/1981 | Ferry | 510/341 |
| 4,465,612 | A * | 8/1984 | Altenschopfer | A01N 57/20 134/22.1 |
| 4,524,013 | A * | 6/1985 | Lamberti | 510/488 |
| 4,690,779 | A * | 9/1987 | Baker et al. | 510/433 |
| 4,973,416 | A * | 11/1990 | Kennedy | 510/296 |
| 5,691,300 | A * | 11/1997 | Fabry et al. | 510/514 |
| 5,880,078 | A * | 3/1999 | Bevilacqua et al. | 510/255 |
| 5,981,449 | A | 11/1999 | Rapisarda et al. | |
| 6,262,003 | B1 * | 7/2001 | Leonard et al. | 510/238 |
| 6,387,991 | B1 | 5/2002 | Hayes | |
| 6,440,924 | B1 | 8/2002 | Jeschke et al. | |
| 6,475,973 | B1 * | 11/2002 | Mondin | 510/417 |
| 6,689,223 | B1 * | 2/2004 | Meine et al. | 134/2 |
| 6,921,743 | B2 | 7/2005 | Scheper et al. | |
| 7,153,817 | B2 | 12/2006 | Binder | |
| 7,842,654 | B2 * | 11/2010 | Sherry et al. | 510/238 |
| 2002/0035051 | A1 * | 3/2002 | Alam et al. | 510/218 |
| 2003/0032568 | A1 * | 2/2003 | Binder | C11D 1/72 510/194 |
| 2005/0143268 | A1 * | 6/2005 | Midha et al. | 510/130 |
| 2006/0035808 | A1 | 2/2006 | Ahmed et al. | |
| 2007/0017553 | A1 | 1/2007 | Neplenbroek et al. | |
| 2007/0253926 | A1 | 11/2007 | Tadrowski et al. | |

FOREIGN PATENT DOCUMENTS

| | | | |
|---|---|---|---|
| CA | 232433 | * | 4/2001 |
| CA | 2324336 | * | 4/2001 |
| CA | 2324336 | A1 | 4/2001 |
| DE | 19922824 | A1 | 11/2000 |
| DE | 19936727 | A1 | 2/2001 |
| DE | 19951635 | A1 | 5/2001 |
| EP | 2221357 | A1 | 8/2010 |
| JP | 11310794 | | 11/1999 |
| JP | 2000265196 | A | 9/2000 |
| JP | 2001233729 | A | 8/2001 |
| JP | 2002506925 | A | 3/2002 |
| JP | 2002509981 | A | 4/2002 |
| JP | 2003506561 | A | 2/2003 |
| JP | 2003521561 | A | 7/2003 |
| JP | 2004500285 | A | 1/2004 |
| JP | 2005525457 | A | 8/2005 |
| WO | 9950380 | A1 | 10/1999 |
| WO | 0136290 | A1 | 5/2001 |
| WO | 2005058700 | A | 6/2005 |

OTHER PUBLICATIONS

Translation of Pertinent portion of Japanese Office Action.

Kuo-Yann Lai: "Liquid Detergents" 1997, Marcel Dekker Inc, USA 67, XP002422136, p. 268.

English Language Abstract for DE19951635 taken from esp@cenet.com.

English Language Abstract for DE19936727 taken from esp@cenet.com.

English Language Abstract for DE19922824 taken from esp@cenet.com.

* cited by examiner

*Primary Examiner* — Nicole M Buie-Hatcher
*Assistant Examiner* — M. Reza Asdjodi
(74) *Attorney, Agent, or Firm* — Troutman Sanders LLP; Ryan Schneider; Chris Davis

(57) ABSTRACT

A low-foaming composition for cleaning a ware-washing machine comprises water, an alkoxylate, an acid (preferably citric acid), and preferably a phase separation promoter (for example a polyethylene glycol or an ionic salt). The composition is in two separate layers under ambient conditions.

19 Claims, No Drawings

COMPOSITION AND METHOD

CROSS REFERENCE TO RELATED APPLICATIONS

This application is a Divisional of U.S. patent application Ser. No. 12/094,300, filed on 23 Jun. 2008, which is a U.S. National Stage Entry of PCT/GB2006/004389, filed on 23 Nov. 2006, which claimed the benefit of Great Britain Application No. 0524009.8, filed on 25 Nov. 2005, all of which are hereby incorporated by reference as if fully set forth below.

BACKGROUND OF THE INVENTION

1. Field of the Invention

The invention relates to a composition for cleaning ware washing machines, for example laundry washing machines and dishwashing machines. Such a composition is hereinafter referred to as a machine-cleaner composition.

2. Description of Related Art

A machine cleaner composition is used on a ware washing machine occasionally, to remove residues which may have built up in the machine over time. The most noticeable such residues in any hard water region are usually limescale, but there may be other residues, for example adherent grease-containing residues in the case of dishwashing machines.

Machine cleaner tablets for automatic dishwashers, food processing machines and the like are known e.g. from US 2003/0032568. Liquid machine cleaning products for automatic dishwashers are known e.g. from U.S. Pat. No. 4,465,612.

It is an object of the invention to offer an excellent machine-cleaner composition, able to remove the residues mentioned above when used in a machine cleaning operation without laundry items or kitchenware present (hereinafter called a dummy wash).

The consumer can thus purchase a dedicated machine-cleaner composition designed to remove resistant long-lasting residues in the machine. It is not intended to wash wares in the machine and therefore there need be no compromise in selecting the components of the composition.

BRIEF SUMMARY OF THE INVENTION

According to a first aspect of the present invention there is provided a low-foaming machine-cleaner composition comprising water, an alkoxylated alcohol and an acid, the composition consisting of two separate layers, under ambient conditions.

Preferably the acid is an organic acid.

According to a second aspect of the invention there is provided a single-shot machine-cleaner container containing a machine-cleaner composition according to the first aspect of the invention.

According to a third aspect of the invention there is provided a method of cleaning a ware-washing machine, using a machine-cleaner composition of the first aspect of the invention or a single-shot machine-cleaner container according to the second aspect of the invention, in a wash cycle of the machine.

According to a fourth aspect of the invention there is provided the use of a machine-cleaner composition of the first aspect of the invention or a single-shot machine-cleaner container of the second aspect of the invention, provided in the wash cycle of a ware-washing machine to clean said machine.

In accordance with another aspect of the present invention there is provided a method of cleaning a ware-washing machine, comprising supplying a machine-cleaner composition of the first aspect of the invention or a single-shot machine-cleaner container according to the second aspect of the invention, to the ware-washing machine and running a wash cycle of said machine without wares in the machine (i.e., a dummy wash) to clean said machine.

In some aspects of the present invention, the machine-cleaner composition comprises water, an alkoxylate and an acid.

In some aspects of the present invention, the machine-cleaner composition comprises two separate layers under ambient conditions.

By ambient conditions we mean a temperature of 20° C. and a pressure of $1.01\times10^5$ Pa.

By low-foaming we mean that the composition does not foam, or forms only a low foam, under machine operation conditions at elevated temperatures, for example 50° C. and above. At lower temperatures it may or may not form a higher foam. When it is a composition which forms a higher foam at lower temperatures the composition is preferably only released into the machine at a higher temperature. For example it may be provided in a pack whose release of the composition is temperature-dependent.

Preferably the composition removes both limescale and grease-containing residues.

It has been found that compositions according to the invention have excellent properties. In particular the compositions have been found to effectively remove both limescale and grease-containing residues. The separation of components of the composition into two separate layers may assist in providing excellent action in removing such different residues. Potentially adverse interaction of separated components is avoided. Furthermore the layered appearance of the composition may be aesthetically pleasing, and reinforce to the consumer the dual action of the composition, in removing both limescale and grease-containing residues.

Preferably, a composition which after shaking is an admixture undergoes a transition or phase separation to a form in which it is a layered composition. This preferably occurs at higher temperatures but not at lower temperatures. By phase separation in this specification we mean the separation of the composition into separate, visually discernible, layers; not the separation of one component as a dispersion in another phase. The temperature at which the composition, if shaken to form an admixture, can form two layers with a distinct interface between them (and below which it cannot) is called herein the phase transition temperature.

Preferably the composition, if shaken to form an admixture, forms two separate layers, under cold conditions.

By cold conditions we mean a temperature of 10° C. and a pressure of $1.01\times10^5$ Pa.

Preferably the composition, if shaken to form an admixture, forms two separate layers under warm conditions.

By warm conditions we mean a temperature of 40° C. and a pressure of $1.01\times10^5$ Pa.

Preferably the composition, if shaken to form an admixture, forms two separate layers under a range of conditions from cold to warm; most preferably throughout the range from 10° C.-40° C., preferably 0° C.-50° C., when at a pressure of $1.01\times10^5$ Pa.

Preferably the composition also contains a phase separation promoter. A phase separation promoter is a component of the composition which encourages phase separation; that is true separation of phases into layers, as opposed to mixing (whether by way of true miscibility of by way of a dispersion, of one phase dispersed in the other).

Suitably a phase separation promoter reduces the phase transition temperature.

Preferably a phase separation promoter used in the composition of the invention, or the totality of phase separation promoters when more than one is present, reduces the phase transition temperature by at least 5° C., more preferably by at least 10° C., and most by at least 20° C.

Preferably a phase separation promoter used in a given composition of the invention, or the totality of phase separation promoters when more than one is present, reduces the phase transition temperature to 20° C. or less, the phase transition temperature of the composition without the phase separation promoter being above 20° C. More preferably it reduces the phase transition temperature to 10° C. or less, the phase transition temperature of the composition without the phase separation promoter being above 10° C., preferably above 20° C. Most preferably it reduces the phase transition temperature to 0° C. or less, the phase transition temperature of the composition without the phase separation promoter being above 0° C., more preferably above 10° C., and most preferably above 20° C.

Aqueous multiple phase detergent compositions are known e.g. DE 19951635.

DETAILED DESCRIPTION OF PREFERRED EMBODIMENTS

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Many different compounds could in principle function as a phase separation promoter. Even in our own early experiments we have determined that several different compounds, of widely differing chemical classes, may function as a phase separation promoters.

Percentage definitions are given below. In this specification a reference to the percentage amount of the defined component is to its percentage by weight on the total weight of the composition, unless otherwise stated. References in this specification to a component, for example a phase separation promoter, or an organic acid, or an alkoxylated alcohol, embrace the possibility that there may be only one such component present, or more than one. When a percentage value is stated for a component in a general definition given herein, including in any claim, that value denotes the total amount present, when more than one such component is present. For example when we state that there may suitably be present up to 25% of a phase separation promoter, this figure denotes the amount of phase separation promoters in total when there is more than one.

Phase Separation Promoters

In general the amount of a phase separation promoter present is suitably at least 0.01%, preferably at least 0.05%, more preferably at least 0.5%, and most preferably at least 1%.

In general the amount of a phase separation promoter present is suitably up to 25%, preferably up to 20%, more preferably up to 15%.

We have determined that suitable phase separation promoters include polyethylene glycols, known as PEG compounds. Preferably PEG compounds are in the range from PEG 400 to PEG 60000.

In general the amount of a PEG compound present is suitably at least 0.2%, preferably at least 0.5%, more preferably at least 1%.

In general the amount of a PEG compound present is suitably up to 15%, preferably up to 10%, more preferably up to 5%.

Further, we have determined that the larger PEG compounds are more effective as phase separation promoters. However PEG compounds of intermediate size—suitable PEG 2000 to PEG 10000, preferably PEG 4000 to PEG 8000—represent a particularly good choice in terms of good phase separation promotion and other properties such as performance/cost profile.

The amount of a lower PEG compound present is suitably at least 2%, preferably at least 4%, more preferably at least 6%. By a lower PEG compound we mean below PEG 2000.

The amount of a lower PEG compound present is suitably up to 15%, preferably up to 12%, more preferably up to 10%.

The amount of an intermediate PEG compound present is suitably at least 1%, preferably at least 2%, more preferably at least 4%. By an intermediate PEG compound we mean from PEG 2000 up to PEG 10000 (and including PEG 2000 and PEG 10000 themselves).

The amount of an intermediate PEG compound present is suitably up to 10%, preferably up to 8%, more preferably up to 6%.

The amount of a higher PEG compound present is suitably at least 0.5%, preferably at least 1%, more preferably at least 2%. By a higher PEG compound we mean above PEG 10000.

The amount of a higher PEG compound present is suitably up to 8%, preferably up to 6%, more preferably up to 4%.

We have determined that suitable phase separation promoters include soluble ionic salts. Examples include alkali metal salts. Preferred salts are sodium salts. Preferred anions are sulphate, chloride, and phosphates, including phosphonates and polyphosphates, for example tripolyphosphate. More than one soluble ionic salt may be present.

The amount of a soluble ionic salt, or of soluble ionic salts in total when there is more than one, is suitably at least 0.1%, preferably at least 0.2%, more preferably at least 0.5%.

The amount of a soluble ionic salt, or of soluble ionic salts in total when there is more than one, is suitably up to 10%, preferably up to 6%, more preferably up to 3%.

Acids

The acid could be an inorganic acid, for example sulphamic acid or a phosphoric acid. Preferably, however, the acid is an organic acid.

Preferably an organic acid is a carboxylic acid. A preferred carboxylic acid is a polycarboxylic acid, most preferably containing 2-4 carboxylic groups, preferably 2-3 carboxylic groups, most preferably 3.

Polycarboxylic acids which comprise one carboxyl group include, for example, formic acid, acetic acid, propanoic acid, trimethylacetic acid, caproic acid, stearic acid, acrylic acid, benzoic acid, salicylic acid, and anthranilic acid.

Polycarboxylic acids which comprise two carboxyl groups include, for example, oxalic acid, malonic acid, succinic acid, glutaric acid, adipic acid, tartronic acid, maleic acid, fumaric acid, diglycolic acid, (ethylenedioxy) diacetic acid, tartaric acid, malic acid and phthalic acid.

Polycarboxylic acids which contain three carboxyl groups include, for example, citric acid.

Polycarboxylic acids which contain four carboxyl groups include, for example, pyromellitic acid.

Citric acid is an especially preferred organic acid, in compositions of the present invention.

Preferably the composition contains at least 1% organic acid, preferably at least 5%, more preferably at least 10%, more preferably at least 13%, and most preferably at least 15%.

Preferably the composition contains up to 30% organic acid, preferably up to 25% and most preferably up to 20%.

Alkoxylates and Alkoxylated Alcohols

Preferred alkoxylates are low-foaming.

Preferably the alkoxylate has an HLB value in the range 6 to 15, preferably 8 to 12, most preferably 9 to 11.

Although alkoxylates which are miscible with water are not excluded provided that they could be made to undergo phase separation, preferred alkoxylates are dispersible in water. Their segregation into a discrete layer may occur over time and/or with increased temperature and/or with the assistance of a phase separation promoter.

Preferably the alkoxylate is an alkoxylated alcohol, especially alcohol ethoxylate, but alcohol propoxylates and mixed alcohol ethoxylates/propoxylates are not excluded. A preferred alkoxylated alcohol for use in this invention is an alcohol ethoxylate having an average 6-20 carbon atoms in the "body", preferably 7-15 especially 7-13, most preferably 9-11; and an average 2-14 moles per mole alcohol, of ethylene oxide in the "tail", preferably 2-8, more preferably 2-6, most preferably 3-5 moles.

Preferably the composition contains at least 1% of alkoxylate, preferably at least 3%, more preferably at least 5%, and most preferably at least 7%.

Preferably the composition contains up to 20% of alkoxylate, preferably up to 16%, more preferably up to 12% and most preferably up to 10%.

In addition to the alkoxylate, which is a non-ionic surfactant, a composition in accordance with the invention may contain surface active agents selected from anionic, cationic, amphoteric, zwitterionic or further non-ionic surfactants or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. However preferred compositions do not contain any anionic cationic, amphoteric or zwitterionic surface active agents; and preferably no non-ionic surfactants other than alkoxylate.

Auxiliaries

Auxiliaries may be present. By auxiliaries we mean components present in small amounts, for example for product preservation, functional or aesthetic reasons. An auxiliary may be, for example, include a preservative, a polymer, a solvent, a hydrotrope, an antifoam, a stabiliser, a thickener, a colorant, a fragrance, and a builder. The acid functions as a builder but an auxiliary may include an additional builder.

The composition may contain up to 20% of one or more auxiliaries, preferably up to 10%, and most preferably up to 5% (in total).

When the composition contains the alkoxylate, acid, water and additional compounds ("auxiliaries") preferably the auxiliaries do not include any hydrophobic (oleophilic) compounds; for example hydrophobic oils, fragrance oils, antifoams or solvents.

Contrasting Parts

Preferably the layers are visually distinct. Suitably they are of different colour (including the possibility that one may be coloured and the other may be clear and colourless). This may be achieved by incorporation of a dye which segregates wholly or predominantly in one layer. Preferably the layers have a well-defined boundary between them.

Water

The water present may be the balance of the composition, once the components mentioned above have been accounted for. It is not necessary to further or precisely define the water content, except to say that it will often be the major component, and may suitably be in the range 51-90%, especially 60-90%, and particularly 65-85%.

Thus, a preferred machine-cleaner composition of the present invention comprises (and most preferably consists essentially of) the following components:

an alkoxylate, preferably 1-20%;

an acid, preferably 1-30% optionally (if needed to achieve or guarantee phase separation) a phase separation promoter, preferably 0.01-25% when present;

optionally, an auxiliary, preferably 0.01-5% when present;

and water;

the composition being in two separate liquid layers, under ambient conditions.

A preferred machine-cleaner composition is provided in a container suitable for single-shot use. That is, the entire composition within the container is used in one machine-cleaning operation (one of the regular wash cycles of the ware washing machine, but with no wares present in the machine).

In accordance with a further aspect of the present invention there is provided a single-shot machine-cleaner container comprising a machine-cleaner composition of the invention, as described and defined herein.

Such a single-shot machine-cleaner container is preferably adapted to be retained in a ware-washing machine, during the wash cycle of the machine.

Preferably the container is adapted to release the composition inside it only once an elevated temperature has been reached; for example 40-65° C.

The container may for example be a generally rigid-walled container, for example a bottle or tub, or it may be a generally flexible-walled container, for example a pouch. Suitably the container is opened by the consumer, placed in the machine to be cleaned, a wash program is selected, and the wash cycle is operated to completion.

Preferably the layers of the composition can be seen through the wall or walls of the container.

The container is preferably sealed by a closure which is not removed before use, but which instead is breached (e.g. disappears) in the medium in which the composition inside the container is to be dispensed. This type of closure is beneficial in keeping the composition separate from the user and only allowed it to be released into the machine in use. It may be designed to ensure the contents are released at the correct point in time in the machine.

Such a closure is preferably solid under ambient conditions but soluble or dispersible in water at an elevated temperature. In use a container having such a closure is suitably located within the machine during the wash cycle.

Suitably the closure comprises a body with a channel extending therethrough, the channel being filled with a material which occludes the closure in storage of the container but which is soluble or dispersible in water at an elevated temperature.

The water-soluble or water-dispersible material may incorporate an anti-foam agent. This has found to be particularly advantageous when the composition in the container is aqueous as often anti-foam agents are hydrophobic. Indeed, any hydrophobic compounds may in principle be formulated in the water-soluble or water-dispersible material. Hydrophobicity compounds such as anti-foam agents can be difficult to integrate into an aqueous composition (often turbidity or separation/settling is observed) and are preferably not present in the composition.

Where present the anti-foam agent may comprise from 40-75% of the water-soluble or water-dispersible material.

Preferred examples of anti-foam agents include silicones.

The water-soluble or water-dispersible material preferably dissolves/disperses at the temperature of operation of an automatic washing machine, usually around 20-80° C., more preferably around 40-65° C., preferably around 50° C. The container can be placed in the machine without the consumer having to open the container and risk exposure to the composition contained therein. During the operation of the machine when the temperature therein exceeds 50° C. the water-soluble or water-dispersible material disappears from the closure and the composition is released. This means that release of the composition into a pre-wash stage (which typically operates at a temperature lower than 50° C.) is avoided.

Most preferably the water-soluble or water-dispersible material dissolves/disperses by melting.

The water-soluble or water-dispersible material preferably comprises a wax, especially paraffin wax. Paraffin wax typically has a melting point of around 50° C.

For protection, e.g. in storage/transport, the closure may have an additional sealing means. Generally the water-soluble or water-dispersible material is covered by a removable sticker (e.g., an aluminium/paper/plastic sticker) before use. The sticker may be peeled away by the consumer before placing the container in the dishwasher. Other additional sealing means may comprise a screw cap.

In accordance with a further aspect of the present invention there is provided a method of cleaning a ware-washing machine, using a machine-cleaner composition or a single-shot machine-cleaner container, as described and defined herein, provided in a wash cycle of the machine.

In accordance with a further aspect of the present invention there is provided the use of a machine-cleaner composition or of a single-shot machine-cleaner container, as described and defined herein, provided in a wash cycle of a ware-washing machine to clean said machine.

In accordance with a further aspect of the present invention there is provided a method of cleaning a ware-washing machine, comprising supplying a machine-cleaner composition or a single-shot machine-cleaner container, as described and defined herein, to the ware-washing machine and running a wash cycle of said machine without wares in the machine (i.e., a dummy wash) to clean said machine.

In some aspects of the present invention, the machine-cleaner composition comprises water, an alkoxylate and an acid.

In some aspects of the present invention, the machine-cleaner composition comprises two separate layers under ambient conditions.

Preferably the method or use employs, or a single-shot container contains, 50-500 ml of the composition, more preferably 100-400 ml, most preferably 200-300 ml.

The composition is further described, by way of illustration, with reference to the following non-limiting Examples.

EXAMPLES

Trial machine-cleaner compositions were prepared by mixing the components listed in Table 1.

TABLE 1

| | Amount in wt % | | | | | |
|---|---|---|---|---|---|---|
| Component | Ex 1 | Ex 2 | Ex 3 | Ex 4 | Ex 5 | Ex 6 |
| Citric acid | 18.0 | 15.0 | 9.8 | 22.7 | 26.0 | 18.0 |
| $C_{9-11}$ alcohol 4EO ethoxylate# | 8.0 | 10.5 | 12.0 | 18.3 | 14.0 | 8.0 |

TABLE 1-continued

| Component | Amount in wt % | | | | | |
|---|---|---|---|---|---|---|
| | Ex 1 | Ex 2 | Ex 3 | Ex 4 | Ex 5 | Ex 6 |
| PEG 400 | — | 12.0 | — | — | — | 12.0 |
| PEG 1500 | — | — | 8.2 | — | — | — |
| PEG 6000 | 2.3 | — | — | — | — | 6.0 |
| PEG 35000 | — | — | — | 3.5 | — | — |
| Sodium tripolyphosphate | 0.1 | — | 0.6 | — | — | 0.1 |
| NaCl | — | — | — | — | 2.5 | — |
| $Na_2SO_4$ | — | — | — | — | 1.5 | — |
| Blue dye | 0.1 | 0.1 | 0.1 | 0.2 | 0.1 | 0.1 |
| UV stabiliser | 0.1 | 0.1 | 0.1 | 0.1 | 0.1 | 0.1 |
| Water | Balance | | | | | |

#BEROL 260 (Registered Trade Mark) from Akzo Nobel.
HLB value 10.5

The compositions of Examples 1 to 5 were blended together at ambient temperature. After vigorous shaking at ambient temperature each was left to stand, and settled into two layers, the upper layer being blue and containing alcohol ethoxylate and the lower layer being colourless and transparent and containing citric acid and water. The compositions were stable in this two layer form at ambient temperature and pressure. Ex. 6 was tested also at 0° C., and it was found that layer separation still occurred. In addition Example 1 was tested for phase separation as described above at different temperatures, and it was found that the layer separation occurred throughout the range 10 to 60° C.

The compositions were also suitable for use as cleaners of dishwashers heavily soiled by limescale and by adherent greasy residues. A Miele G 676SC dishwasher was used, and the 65 Universal or Fine 45 program was selected. The dishwasher was empty of kitchenware. 250 ml of each composition was used. Each composition was found to be highly effective in cleaning the respective dishwasher.

Good results have also been obtained when replacing the BEROL 260 surfactant with LUTENSOL A04 ($C_{13-15}$ alcohol ethoxylate, 5EO) and PLURAFAC LF 303 (fatty alcohol alkoxylate). BEROL, LUTENSOL and PLURAFAC are believed to be Registered Trade Marks.

While several possible embodiments are disclosed above, embodiments of the present invention are not so limited. For instance, while several possible configurations of materials for the machine-cleaner composition or the single-shot machine-cleaner container, and methods for using said composition or container in cleaning machines have been disclosed, other suitable materials and combinations of materials, as well as steps in methods of use, could be selected without departing from the spirit of embodiments of the invention. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. A method of cleaning a ware-washing machine, comprising:

supplying a liquid machine-cleaner composition to the ware-washing machine; and running a wash cycle of the machine at 50° C. or above, without wares in the machine;

wherein the liquid machine-cleaner composition comprises water, an alkoxylate, a stabilizer and an acid, wherein the alkoxylate is an alcohol ethoxylate having an average 6-20 carbon atoms in the "body" and an average 2-14 moles of ethylene oxide in the "tail", per mole of the alcohol, wherein the liquid machine-cleaner composition comprises two separate liquid layers under ambient conditions; and wherein the liquid machine-cleaner composition does not contain any anionic surface active agents.

2. The method according to claim 1, wherein the liquid machine-cleaner composition is in two separate layers throughout the range from 0° C.-50° C. when at a pressure of $1.01\times10^5$ Pa.

3. The method according to claim 1, wherein the liquid machine-cleaner composition further comprises a phase separation promoter.

4. The method according to claim 3, wherein the liquid machine-cleaner composition comprises 0.01 to 25 wt % of the phase separation promoter.

5. The method according to claim 3, wherein the phase separation promoter is selected from one or more of a polyethylene glycol and a soluble ionic salt.

6. The method according to claim 3, wherein the phase separation promoter is a polyethylene glycol in the range from PEG 2000 to PEG 10000.

7. The method according to claim 1, wherein the acid is present in an amount from 1 to 30 wt %.

8. The method according to claim 1, wherein the acid is an organic acid.

9. The method according to claim 8, wherein the organic acid is a carboxylic acid.

10. The method according to claim 9, wherein the carboxylic acid is citric acid.

11. The method according to claim 1, wherein the alkoxylate is present in an amount from 1 to 20 wt %.

12. The method according to claim 1, wherein the alkoxylate has an HLB value in the range 6 to 15.

13. The method according to claim 1, wherein the alcohol ethoxylate has an average 7-15 carbon atoms in the "body" and an average 2-6 moles ethylene oxide in the "tail", per mole of the alcohol.

14. The method according to claim 1, wherein the liquid machine-cleaner composition is substantially free from hydrophobic compounds.

15. The method according to claim 1, wherein the liquid machine-cleaner composition consists essentially of:

the alkoxylate;

an acid;

water;

and optionally, an auxiliary.

16. The method according to claim 1, wherein the liquid machine-cleaner composition consists essentially of:

the alkoxylate;

an acid;

water;

a phase separation promoter;

and optionally, an auxiliary.

17. The method according to claim 1, wherein the liquid machine-cleaner composition is supplied to the machine from a single-shot machine-cleaner container.

18. The method according to claim 17, wherein the layers of the liquid machine-cleaner composition are visually distinct and may be seen through the wall(s) of the single-shot machine-cleaner container.

19. The method according to claim 17, wherein the single-shot machine-cleaner container is sealed by a closure which is not removed before use, but which instead is breached in use in the machine, the closure being solid under ambient conditions but soluble or dispersible in water at an elevated temperature.

* * * * *